United States Patent [19]

Perry

[11] Patent Number: 4,979,382

[45] Date of Patent: Dec. 25, 1990

[54] SECURITY APPARATUS

[76] Inventor: Robert C. Perry, 5755 SW. Willow La., Lake Oswego, Oreg. 97035

[21] Appl. No.: 479,063

[22] Filed: Feb. 12, 1990

[51] Int. Cl.[5] ..... E05B 73/00

[52] U.S. Cl. ..... 70/58; 70/232; 248/553

[58] Field of Search ..... 70/57, 58, 229–232; 248/551, 553

[56] References Cited

U.S. PATENT DOCUMENTS

| | | | |
|---|---|---|---|
| 3,744,282 | 7/1973 | Hemphill | 70/58 |
| 3,859,826 | 1/1975 | Singer et al. | 70/58 |
| 3,990,276 | 11/1976 | Shontz | 70/58 |
| 4,065,946 | 1/1978 | Loynes et al. | 70/58 |
| 4,066,231 | 1/1978 | Bahner et al. | 70/58 X |
| 4,227,707 | 10/1980 | Baker et al. | 70/58 X |
| 4,305,266 | 12/1981 | Lockwood | 70/58 |
| 4,448,049 | 5/1984 | Murray | 70/58 |
| 4,603,829 | 8/1986 | Koike et al. | 70/58 X |
| 4,739,637 | 4/1988 | Finkel et al. | 70/58 |
| 4,817,402 | 4/1989 | Leiding | 70/58 |
| 4,825,669 | 5/1989 | Herrerra | 70/232 X |
| 4,907,522 | 3/1990 | Lutzke | 70/57 X |

*Primary Examiner*—Gary L. Smith
*Assistant Examiner*—Suzanne L. Dino
*Attorney, Agent, or Firm*—Dellett, Smith-Hill and Bedell

[57] ABSTRACT

Apparatus for attaching a component of a personal computer to a desk comprises a first plate having a hole extending therethrough, the hole having a countersunk recess at a first surface of the first plate. The first plate can be secured at its first surface to a surface of a component of a personal computer. A fastening element extends through the hole in the first plate and has a head received in the countersunk recess. A second plate has first and second surfaces and has a first hole for receiving the fastening element, whereby the fastening element may be used to secure the plates together in confronting relationship. A rod extends through a second hole in the second plate and projects from the second plate in the direction away from the first plate. The rod has a portion that is captive between the first and second plates when the plates are secured together by the fastening element.

5 Claims, 2 Drawing Sheets

SECURITY APPARATUS

BACKGROUND OF THE INVENTION

This invention relates to security apparatus, and is particularly concerned with apparatus for attachment to components of a personal computer to deter their unauthorized removal.

Unauthorized removal of components of personal computers represents a major security problem in certain institutions, such as colleges, where there are not elaborate security measures restricting access to the institution so that the institution is, in effect, open to the public, and the legitimate users of the institution may need access to personal computers in order to carry out their studies.

Many attempts have been made to provide security devices that will deter unauthorized removal of a component of a personal computer. However, many devices are inconvenient and inefficient.

Raskin, U.S. Pat. No. 3,664,616, discloses locking apparatus for an office machine, such as a typewriter. A frame is attached to the underside of the machine, and a bolt projects downwardly from the frame. The bolt extends through a hole in a desk, and a locking barrel is fitted to the bolt. In this manner, the office machine is securely attached to the desk yet can be removed without damaging the desk by use of an appropriate key. A disadvantage of the device shown by Raskin is that the user of the machine is not able to adjust the position of the machine to suit his comfort and convenience.

Singer et al, U.S. Pat. No. 3,743,224, discloses a typewriter swivel lock mount which is somewhat similar to that shown by Raskin except that it permits limited movement of the machine.

Bahner et al, U.S. Pat. No. 4,066,231, discloses a stand for securing a small, portable device, such as a calculator, to a desk. A flexible cable is releasably attached to the portable device and extends downwardly through the stand and a hole in a desk. At its lower end, the cable is provided with a bar formed with holes to accommodate a padlock. When the portable device is mounted in the stand and the padlock is installed, the cable cannot be detached from the portable device.

D'Amore, U.S. Pat. No. 4,733,840, discloses a security system for an office machine, in which a security plate is fixed to the machine and a cable is used to attach the security plate to a desk.

Finkel et al, U.S. Pat. No. 4,739,637, discloses a locking device for an office machine. The locking device comprises a first plate that is attached to the underside of the machine and a second plate that is secured to the surface of a desk. When the first plate is placed on top of the second plate, the two plates can be releasably locked together.

Most personal computers that are in use comprise a processing unit and various peripheral devices, such as printers, keyboards and displays. The security devices described above are not adapted to this type of computer, in that one security device would be required to secure each component of the computer. Further, the devices shown by Raskin and Singer for example, are not readily applicable to securing a display device, which is typically placed on top of the processing unit.

SUMMARY OF THE INVENTION

In accordance with the present invention, apparatus for attaching a component of a personal computer to a desk comprises a first plate member having first and second surfaces and having at least one hole extending therethrough, the hole having a countersunk recess at the first surface of the first plate member. The first plate member can be secured at its first surface to a surface of a component of a personal computer. A fastening element extends through the hole in the first plate member and has a head received in the countersunk recess. A second plate member has first and second surfaces and has a first hole for receiving the fastening element, whereby the fastening element may be used to secure the plate members together in confronting relationship. An elongate attachment member extends through a second hole in the second plate member and projects from the second plate member in the direction away from the first plate member, the elongate attachment member having a portion that is captive between the first and second plate members when the plate members are secured together by the fastening element.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION

Figure 1:
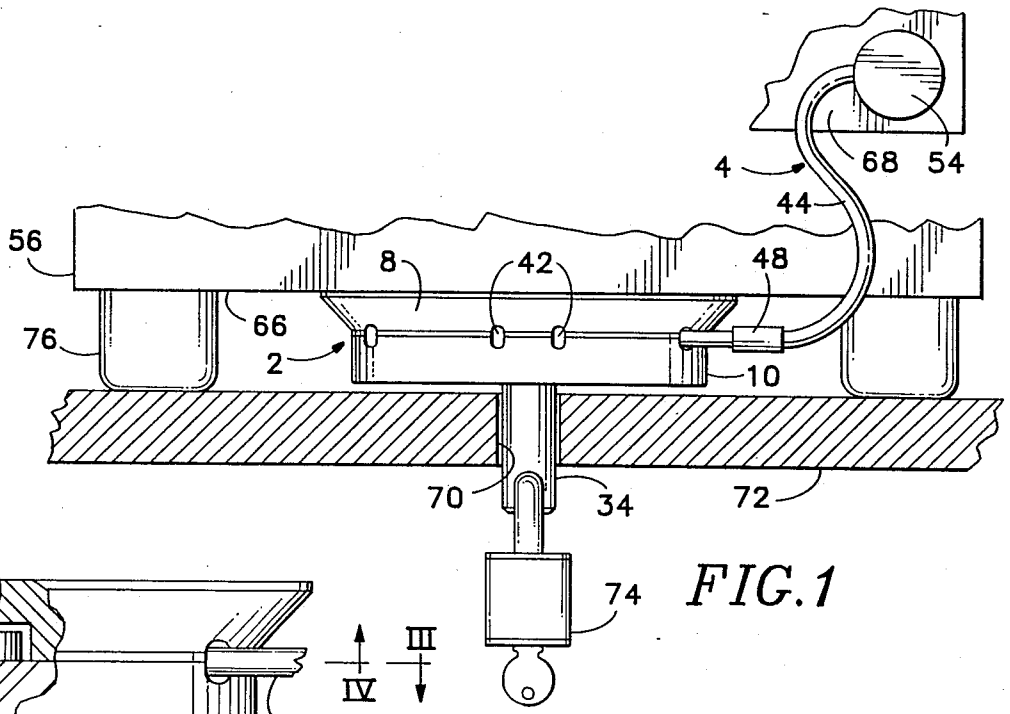
FIG. 1 is a partial side elevation illustrating security apparatus in accordance with the present invention.
Figure 2:
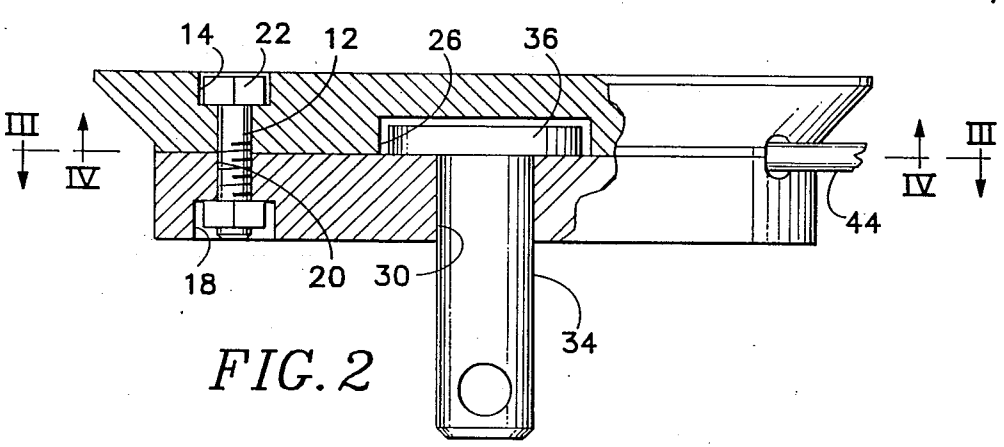
FIG. 2 is an enlarged side view, partly in section, illustrating a central anchor that forms part of the security apparatus.
Figure 3:
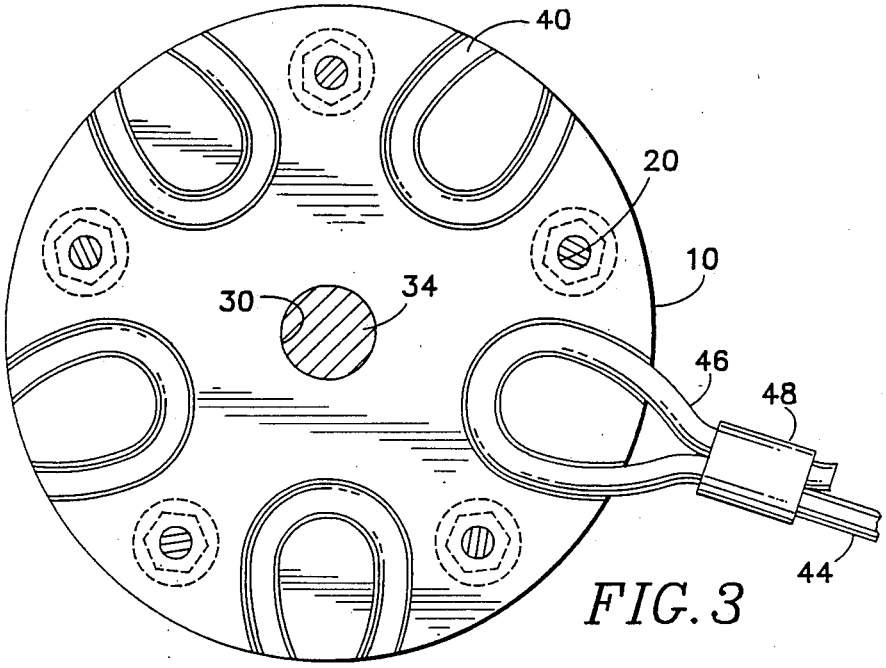
FIG. 3 is a sectional view taken on the line A—A of FIG. 2.
Figure 4:
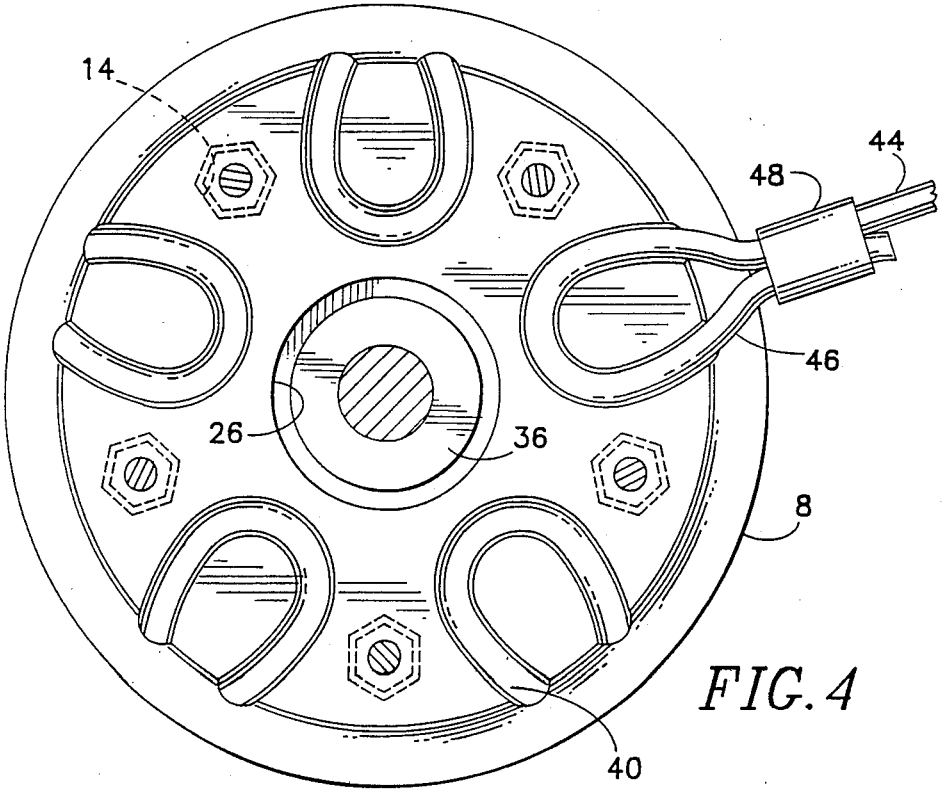
FIG. 4 is a sectional view taken on the line B—B of FIG. 2.

The security apparatus shown in the drawings comprises a central anchor 2 and several (up to five in the case of the illustrated embodiment) peripheral anchors 4.

The central anchor comprises first and second plates 8 and 10, each made of PVC or some other substantially rigid material. Plate 8 is formed with five cylindrical holes 12, and plate 10 is formed with five cylindrical holes 20. The holes in plate 8 are countersunk with hexagonal recesses 14, and the holes in plate 10 are countersunk with circular recesses 18. Hexagonal-headed bolts 22 are fitted in holes 12, the heads of the bolts being received in the recesses 14 and being held therein against rotation relative to plate 8. Plates 8 and 10 can be secured firmly together by fitting plate 10 so that bolts 22 extend through holes 20 and applying nuts to the bolts, the nuts being received in recesses 18.

Plate 8 is formed with a shallow recess 26 at the center of its lower surface, and plate 10 is formed with a central hole 30. A pin 34 of hardened steel and having a head 36 is fitted in hole 30 before plates 8 and 10 are fastened together. The head 36 of pin 34 is received in recess 26, and accordingly pin 34 is held captive in a mechanically positive locking fashion by plates 8 and 10.

At their confronting surfaces, plates 8 and 10 are each formed with five grooves 40. Each groove is substantially horseshoe-shaped when viewed in plan, and is semi-circular in cross-section. The grooves in plate 10 register with the grooves in plate 8 when the two plates are secured together, so that passages 42 of circular cross-section are thereby formed.

Peripheral anchor 4 comprises a flexible steel cable 44 having a neoprene jacket. Cable 44 is formed with a loop 46 at one end, a ferrule 48 being used to secure the loop. The loop 46 is sized to fit in one of the passages 42. At its opposite end, cable 44 is attached to a disc or plate 54 of PVC or other substantially rigid material. The disc has a flat attachment surface. A hole is drilled in disc 54 from its periphery. The neoprene jacket is removed from the end of the cable so as to expose the twisted strands of steel. Epoxy adhesive material is introduced into the hole in the peripheral surface of disc 54, and while the adhesive material remains liquid, the end of cable 44 is inserted into the hole. Liquid adhesive material penetrates among the strands of the cable. When the adhesive material is cured, the cable is securely attached to disc 54.

In use of the apparatus shown in the drawings, a cyanocrylate adhesive having gap-filling properties, such as the adhesive sold by Spacer Tech under the trademark "Zap Gap", is applied to the upper surface of plate 8 and to the attachment surface of disc 54. Plate 8 is attached to the flat bottom surface 66 of the processing unit 56 of a personal computer and disc 54 is attached to the flat surface 68 of a portion of the housing of a peripheral device, such as a printer. The adhesive material secures the plate 8 and disc 54 firmly to the respective components even though surfaces 66 and 68 are not completely flat, because of the gap-filling properties of the adhesive. The loop of cable 44 is fitted in one of the recesses 40 of plate 8, and pin 34 is fitted in hole 30 of plate 10. Plates 8 and 10 are then secured together by applying nuts 18 to bolts 22. In this fashion, cable 44 is releasably held by the central anchor in mechanically positive locking relationship. The processing unit is then placed so that pin 34 extends downwardly through a hole 70 in a desk 72, and the shackle of a padlock 74 is inserted through the hole at the lower end of pin 34. In this fashion, the processing unit is firmly secured to the desk. The peripheral device is secured firmly to the desk, but remains movable relative to the desk. Therefore, if the peripheral device is a keyboard, the user is able to adjust the position of the keyboard to suit his own convenience and comfort, within the limits imposed by the length of cable 44. The central anchor does not interfere with placing the processing unit on the desk, because the combined height of plates 8 and 10 is less than the height of the support feet 76 on the underside of the housing of the processing unit.

It will be appreciated that the invention is not restricted to the particular embodiment that has been described, and that variations may be made therein without departing from the scdpe of the invention as defined in the appended claims and equivalents thereof. For example, although the central anchor device is protected from tampering by virtue of its being secured to the underside of the processing unit and the processing unit's being secured to the desk by the lock, the central securing device is fairly resistant to tampering and could, therefore, be secured to the desk separately from the processing unit, which could then be attached to the central anchor device by a cable and a peripheral anchor.

I claim:

1. Apparatus for securing an article to a desk, comprising:

a first plate member having first and second surfaces and having at least one hole extending therethrough, the hole having a countersunk recess at the first surface of the first plate member, a fastening element extending through the hole in the first plate member, the fastening element having a head received in the countersunk recess of the hole in the first plate member, a second plate member having first and second surfaces and having a first hole for receiving the fastening element, whereby the fastening element may be used to secure the plate members together with the first surface of the second plate member in confronting relationship with the second surface of the first plate member, and also having a second hole, and an elongate attachment member extending through the second hole in the second plate member and projecting from the second plate member in the direction away from the first plate member, the elongate attachment member having a portion that is captive between the first and second plate members when the first and second plate members are secured together by the fastening element, and wherein at least one of the second surface of the first plate member and the first surface of the second plate member is formed with a recess, and the apparatus further comprises at least one flexible cable having first and second ends, the first end of the cable being captive in said recess and the second end being provided with means for attachment to an article to be secured.

2. Apparatus according to claim 1, wherein the recess is in the form of a channel having first and second ends spaced apart along the peripheral surface of the plate member, and the cable is formed at its first end with a loop received in the channel.

3. Apparatus according to claim 1, wherein the second surface of the first plate member and the first surface of the second plate member are each formed with a recess, the recesses being in registration when the first and second plate members are secured together by the fastening element.

4. Apparatus according to claim 1, wherein the fastening element comprises a bolt having a hexagonal head and a nut, the countersunk recess at the first surface of the first plate member is hexagonal, the head of the bolt is received in the countersunk recess of the first plate member, whereby the bolt is held against rotation relative to the first plate member, and the second plate member has a countersunk recess at its second surface and the nut is received in the countersunk recess of the second plate member.

5. Apparatus according to claim 1, wherein the first plate member is formed with a recess at its second surface and the elongate attachment member comprises a pin having an enlarged head received in the recess at the second surface of the first plate member.

* * * * *